US006505481B2

(12) United States Patent
Neumann et al.

(10) Patent No.: US 6,505,481 B2
(45) Date of Patent: Jan. 14, 2003

(54) REFRIGERANT CONDENSER

(75) Inventors: Olaf Neumann, Heilbronn (DE); Siegfried Tews, Stuttgart (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 10/024,343

(22) Filed: Dec. 21, 2001

(65) Prior Publication Data

US 2002/0083735 A1 Jul. 4, 2002

(30) Foreign Application Priority Data

Dec. 23, 2000 (DE) ..... 100 65 205

(51) Int. Cl.[7] ..... F25B 39/04
(52) U.S. Cl. ..... 62/506; 62/509; 135/132
(58) Field of Search ..... 62/506, 509; 135/132

(56) References Cited

U.S. PATENT DOCUMENTS

| | | | | | |
|---|---|---|---|---|---|
| 5,348,081 | A | * | 9/1994 | Halstead et al. | 165/144 |
| 5,526,876 | A | * | 6/1996 | Karube | 165/174 |
| 5,537,839 | A | | 7/1996 | Burk et al. | 62/474 |
| 5,570,737 | A | * | 11/1996 | Tokutake | 165/67 |
| 5,720,341 | A | * | 2/1998 | Watanabe et al. | 165/135 |
| 5,875,650 | A | | 3/1999 | Nobuta et al. | 62/509 |
| 5,974,828 | A | | 11/1999 | Guerand | 62/509 |
| 6,032,728 | A | * | 3/2000 | Ross et al. | 165/153 |
| 6,038,877 | A | * | 3/2000 | Peiffer et al. | 62/244 |

FOREIGN PATENT DOCUMENTS

| | | |
|---|---|---|
| DE | 42 38 853 | 5/1994 |
| DE | 196 45 502 | 5/1997 |
| DE | 198 30 329 | 1/1999 |
| DE | 198 49 528 | 12/2000 |
| DE | 199 57 945 | 6/2001 |
| EP | 0 769 666 | 4/1997 |
| FR | 2 754 887 | 4/1998 |
| FR | 2 757 610 | 6/1998 |
| WO | 01/01051 | 1/2001 |

OTHER PUBLICATIONS

Shitaya et al., "Refrigerant Condensing Device and Refrigerant Condenser," Patent Abstracts of Japan, Publ. No. 10009713, Jan. 16, 1998.
Onodera et al. , "Heat Exchanger," Patent Abstracts of Japan, Publ. No. 00039290, Feb. 8, 2000.
Matsuo et al., "Heat Exchanger with Liquid Receiver," Patent Abstracts of Japan, Publ. No. 00097518, Apr. 4, 2000.
Roland Burk, "Condenser Module for Automotive Air–Conditioners," ATZ, vol. 5, 1995.

* cited by examiner

*Primary Examiner*—William E. Tapoicai
*Assistant Examiner*—Mohammad M. Ali
(74) *Attorney, Agent, or Firm*—Foley & Lardner

(57) ABSTRACT

The present invention relates to a refrigerant condenser for motor vehicle air-conditioning systems of the type that include a tube/fin block, header tubes arranged on both sides of the tube/fin block and a collector arranged parallel to one header tube, wherein the header tubes have partitions for creating a multi-pass flow of the refrigerant, and the tube/fin block has an upper condensation region and a lower supercooling region. The collector is flow-connected via passage orifices to the condensation region, on the one hand, and to the supercooling region, on the other hand. The collector has approximately the same diameter or the same cross section as the adjacent header tube, and an additional container of larger cross section or larger diameter is provided for storing refrigerant and/or for receiving a dryer and/or filter. The container is connected to the collector, either in parallel or in series, via connecting lines, with one of the connecting lines being connected between the condensation region and supercooling region.

12 Claims, 4 Drawing Sheets

REFRIGERANT CONDENSER

CROSS-REFERENCE TO RELATED PATENT APPLICATIONS

Germany Priority Application 100 65 205.0, filed Dec. 23, 2000 including the specification, drawings, claims and abstract, is incorporated herein by reference in its entirety.

BACKGROUND OF THE INVENTION

The present invention relates to a refrigerant condenser for motor vehicle air-conditioning systems of the type that include a tube/fin block, header tubes arranged on both sides of the tube/fin block and a collector arranged parallel to one header tube, wherein the header tubes have partitions for creating a multi-pass flow of the refrigerant, and the tube/fin block has an upper condensation region and a lower supercooling region. The collector is flow-connected via passage orifices to the condensation region, on the one hand, and to the supercooling region, on the other hand.

A refrigerant condenser of this type is known from commonly-assigned DE-A 42 38 853 (corresponding to U.S. Pat. No. 5,537,839) which is incorporated herein by reference. In this so-called condenser module, the collector, which serves for separating the refrigerant into the liquid phase and the vapor phase, for receiving excess refrigerant and for drying, is integrated together with the condenser to form a structural unit. In this case, the collector has a cross section or diameter which is greater than the adjacent parallel header tube. This results, for the entire condenser module, in an increased construction depth (as seen in the airflow direction), as compared with the construction depth of the tube/fin block or of the header tubes. In specific installation situations in the motor vehicle, this may be a disadvantage, to be precise when the space necessary for the collector is not available.

SUMMARY OF THE INVENTION

It is therefore one object of the invention to provide an improved refrigerant condenser of the known type so that it is possible to install the condenser, even under confined space conditions, without impairing the functioning of the condenser.

A further object of the invention is to provide a motor vehicle embodying the improved refrigerant condenser according to the invention.

In accomplishing the foregoing objects of the invention, there has been provided in accordance with one aspect of the invention a refrigerant condenser for a motor vehicle air-conditioning system, comprising: a tube/fin block; header tubes arranged on both sides of the tube/fin block, the header tubes having partitions for creating multi-pass flow of the refrigerant to produce in the tube/fin block an upper condensation region and a lower supercooling region; a collector arranged parallel and adjacent to one of the header tubes and being in communication via a first passage with the condensation region, and via a second passage with the supercooling region, wherein the collector has a diameter or cross section essentially the same or less than the cross section of the adjacent header tube; and a separate container having a cross section larger than the cross section of the adjacent header tube, for storing refrigerant and receiving at least one of a dryer and a filter, the container being in communication with the collector via connecting lines, wherein a first connecting line is connected to the collector between the first passage to the condensation region and the second passage to the supercooling region.

In accordance with another aspect of the invention, there has been provided a motor vehicle comprising an air-conditioning system that includes a refrigerant condenser as defined above.

According to another aspect of the invention, there is provided a motor vehicle comprising an engine cooling system including a radiator, and an air-conditioning system including a refrigerant condenser, wherein the condenser comprises a condenser as defined above and wherein the condenser and the radiator are mounted in the motor vehicle contiguously in face-to-face relationship. In a preferred embodiment, the motor vehicle further comprises a third heat exchanger that is mounted directly adjacent to the radiator or the condenser. The third heat exchanger preferably comprises at least one of an oil cooler and a charge air cooler.

Further objects, features and advantages of the invention will become apparent from the detailed description of preferred embodiments that follows, when considered together with the accompanying figures of drawing.

DETAILED DESCRIPTION OF THE PREFERRED EMBODIMENTS

Figures 1A, 1B, 1C:
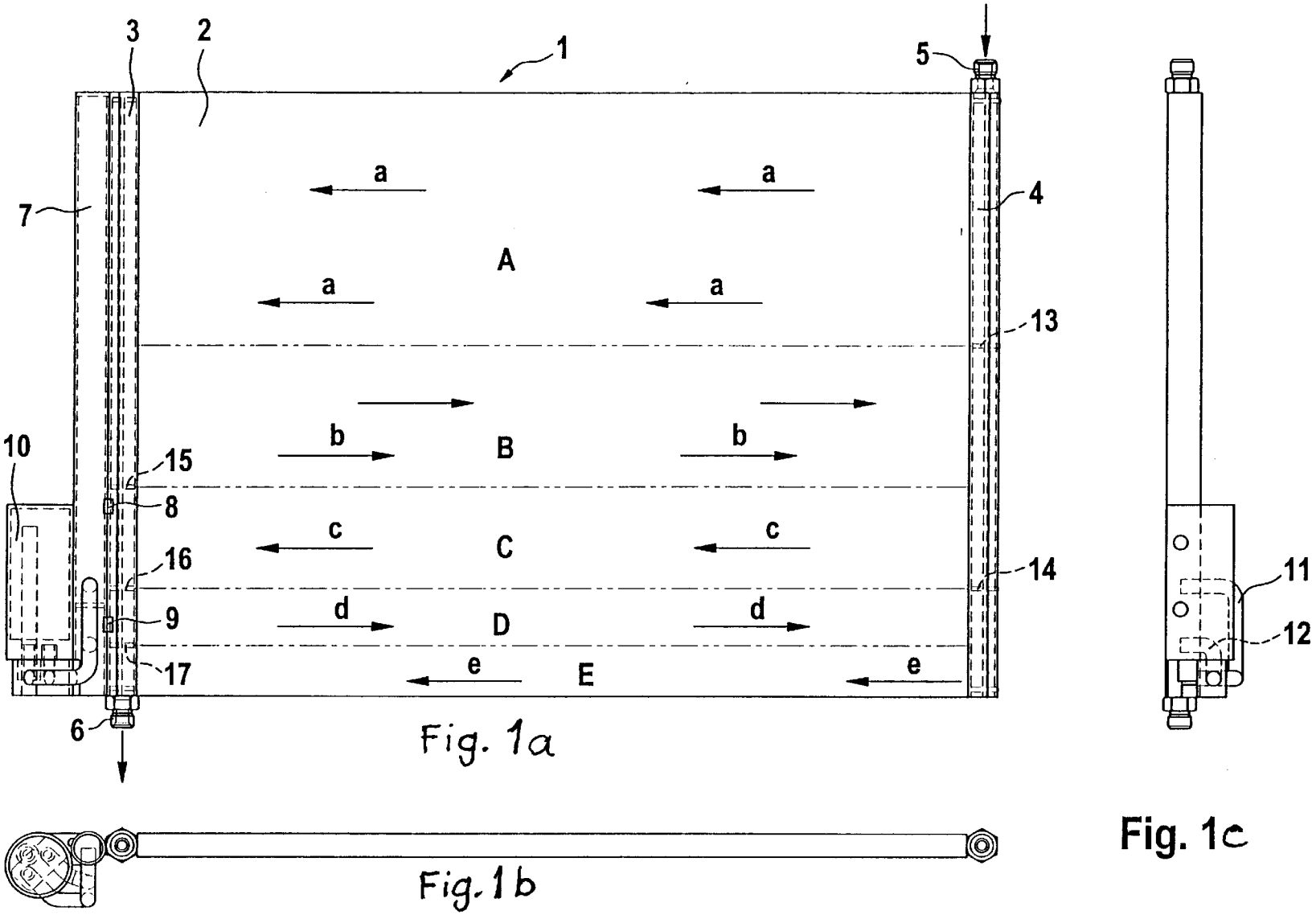
FIGS. 1*a* through 1*c* are front, top and side views of the condenser with an additional container according to the invention.

According to the invention, the collector has approximately the same diameter or the same cross section as the adjacent header tube, and an additional container of larger cross section or larger diameter is provided for storing refrigerant and/or for receiving a dryer and/or filter. The container is connected to the collector, either in parallel or in series, via connecting lines, with one of the connecting lines being connected between the condensation region and supercooling region.

This combination of features affords the advantage, in the first place, that the collector can be designed with a smaller cross section or construction depth, to be precise, so as to correspond approximately to the cross section of the header tube. This collector of reduced cross section is followed by a separate container for receiving additional refrigerant and preferably for receiving a dryer, i.e., the additional container is located downstream of the condensation region of the condenser and upstream of the supercooling region in the refrigerant flow direction. The region of constant supercooling (what is known as the plateau as a function of the refrigerant filling quantity according to ATZ, Vol. 5, 1995, Roland Burk, Kondensatormodul für Kraftfahrzeug-Klimaanlagen, [Condenser module for motor vehicle air-conditioning systems], FIG. 5b) is thus enlarged. The collector serves, as before, for separating the refrigerant phases, and it receives merely a smaller refrigerant volume; the missing volume necessary for the entire refrigerant circuit is provided by the additional container which is arranged at a suitable point, that is to say, where there is room in the vehicle. This form of construction thus achieves a reduction in the construction depth of the condenser.

It is known from FR-A 2 757 610 to provide, in the case of a condenser, a separate container with dryer and filter which is connected between the condensation region and the supercooling region of the condenser. However, this separate container is connected directly to the header tube of the condenser, and hence there is no integrated collector here.

Furthermore, it is known from DE-A 196 45 502 to arrange and fasten a separate dryer below the condenser, but this dryer is located downstream of the supercooling region.

In light of this prior art, therefore, the invention involves "splitting" functionally and spatially the known refrigerant collector, which was either completely integrated with the condenser or was designed as a separate container, i.e., to split it into an integrated smaller collector and a separate larger collector, the volume of which is likewise returned into the supercooling zone and thus contributes to constant supercooling. This idea results in a number of unobvious improvements.

In an advantageous embodiment of the invention, the collector has a partition which is arranged between the first junction orifice and the second junction orifice of the connecting lines to the separate collector. The additional collector container is thereby connected in series between the two chambers of the integrated collector, i.e., between the condensation region and supercooling region.

In another advantageous embodiment of the invention, the cross section of the additional container is substantially larger than the cross section of the collector, and the height of the additional container is substantially smaller than that of the collector or that of the entire condenser. It is thereby possible for the entire condenser, together with the additional container, to be adapted individually to the respective installation conditions in the motor vehicle. There is an advantageous dimensioning of the additional dryer container when the latter has approximately double to triple the diameter of the collector and one third to half its height. A reduction in the construction depth is thus achieved for the remaining part of the height of the condenser.

Exemplary embodiments of the invention are illustrated in the drawing and described in more detail below.

FIGS. 1*a* through 1*c* show the entire condenser 1 in a view from the front, from the top and from the side, respectively. The condenser 1 has a tube/fin block 2 which is composed of conventional flat tubes, not illustrated in any more detail, and of corrugated ribs arranged between these, for example as illustrated and described in U.S. Pat. No. 5,537,839. Arranged on both sides of this tube/fin block, of which the tubes (not illustrated in detail) run in a horizontal direction, are header tubes 3 and 4 which are flow-connected to the flat tubes and are brazed to these, in the conventional manner. The right header tube 4 has a refrigerant inlet connection piece 5 in its upper region, and the left header tube 3 has a refrigerant outlet connection piece 6 in its lower region. Arranged parallel to the left header tube 3 is a tubular collector 7 which is flow-connected via two passage orifices 8 and 9 to the header tube 3. Arranged in the lower left region, parallel to the header tube 3 and to the tubular collector 7, is an additional container 10 which is flow-connected to the collector 7 via two connecting lines 1 1 and 12.

The header tubes 3 and 4 have partitions 13, 14 and 15, 16, 17 which bring about a multiple deflection of the refrigerant from the inlet 5 to the outlet 6, to produce a multi-pass flow pattern. These partitions 13 to 17 result, overall, in 5 flow passages (streams) which are illustrated diagrammatically by the upper-case letters A, B, C, D, E or by arrows marked by the lower-case letters a, b, c, d, e. The sections A, B and C consequently form the condensation section, in which the refrigerant initially entering in vapor form is condensed to the greatest possible extent, so that, when it flows through the passage orifice 8 over into the collector 7, it is for the most part in a liquid phase. The two lowest sections D and E form what is known as the supercooling region, in which the already liquid refrigerant is cooled to below its condensation temperature.

Figure 2:
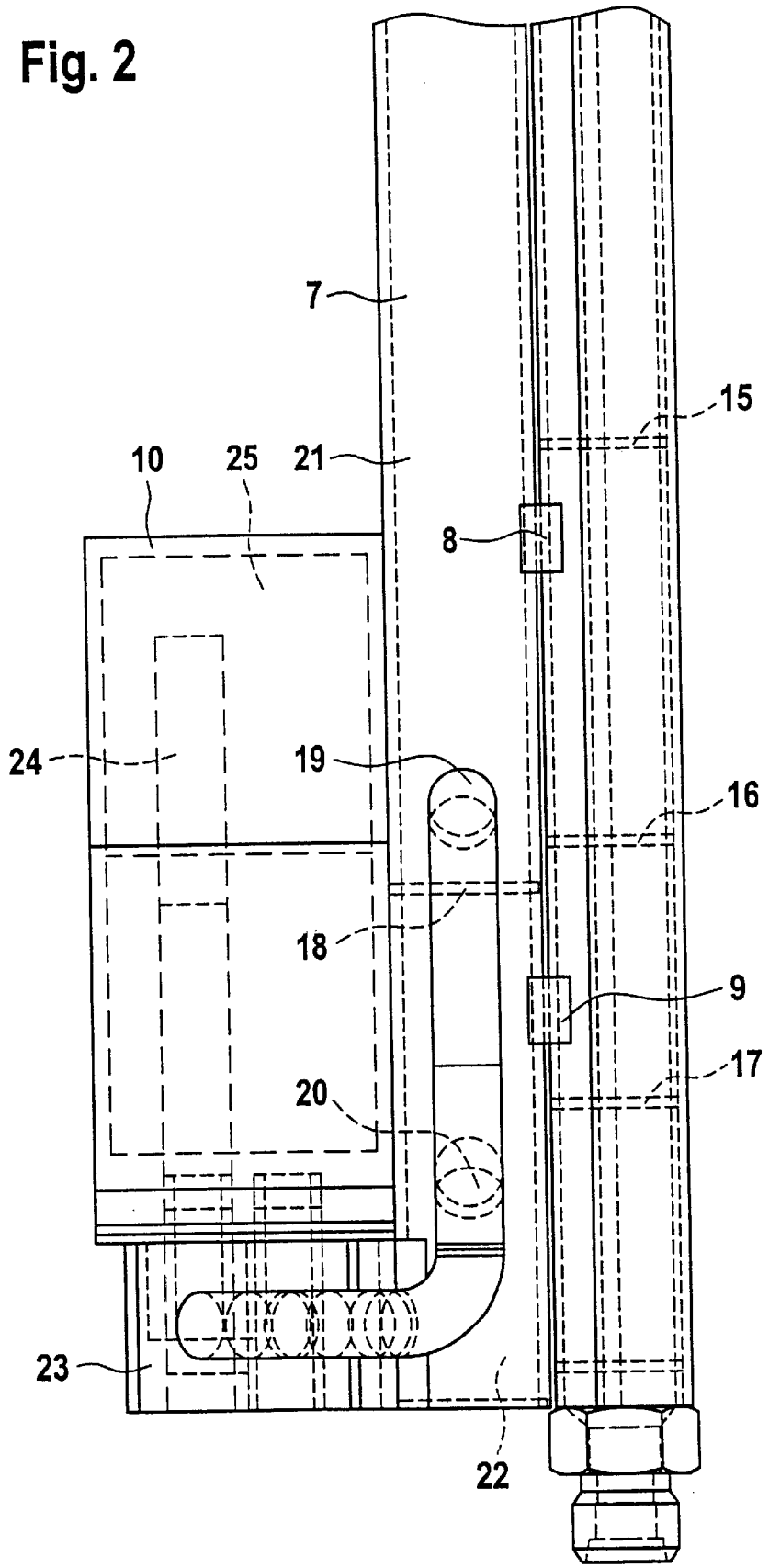
FIG. 2 is an enlarged side view showing more detail of the container housing a dryer.
Figure 3:
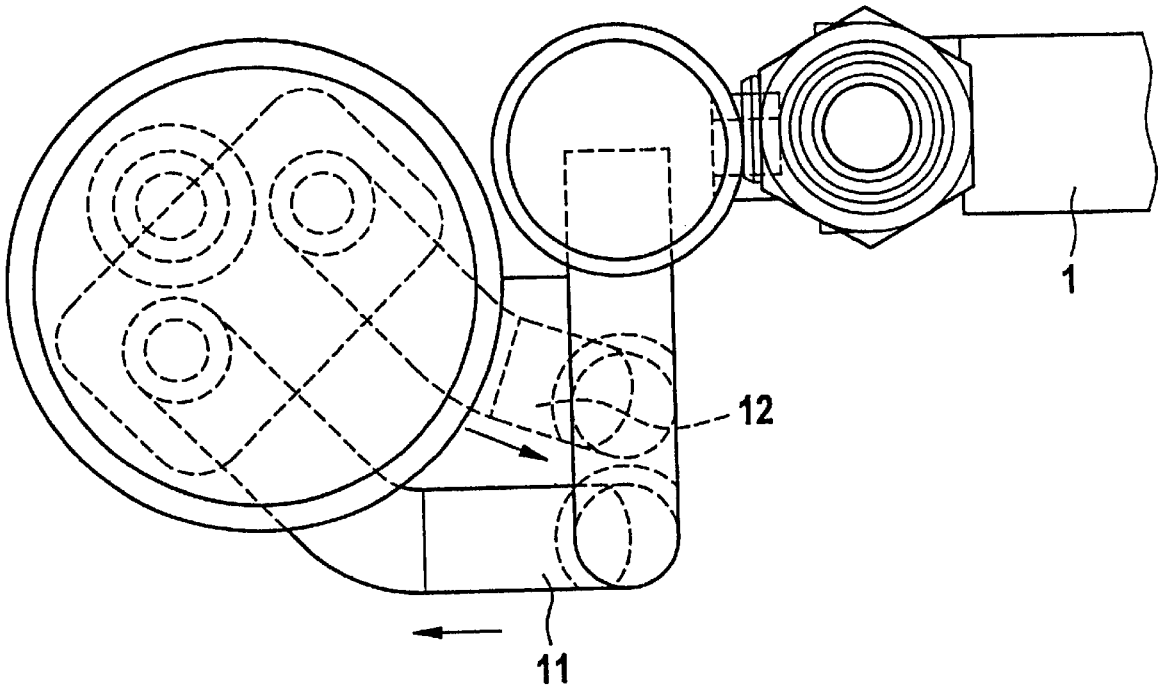
FIG. 3 is a top view showing an enlarged view of the container housing a dryer.
Figure 4:
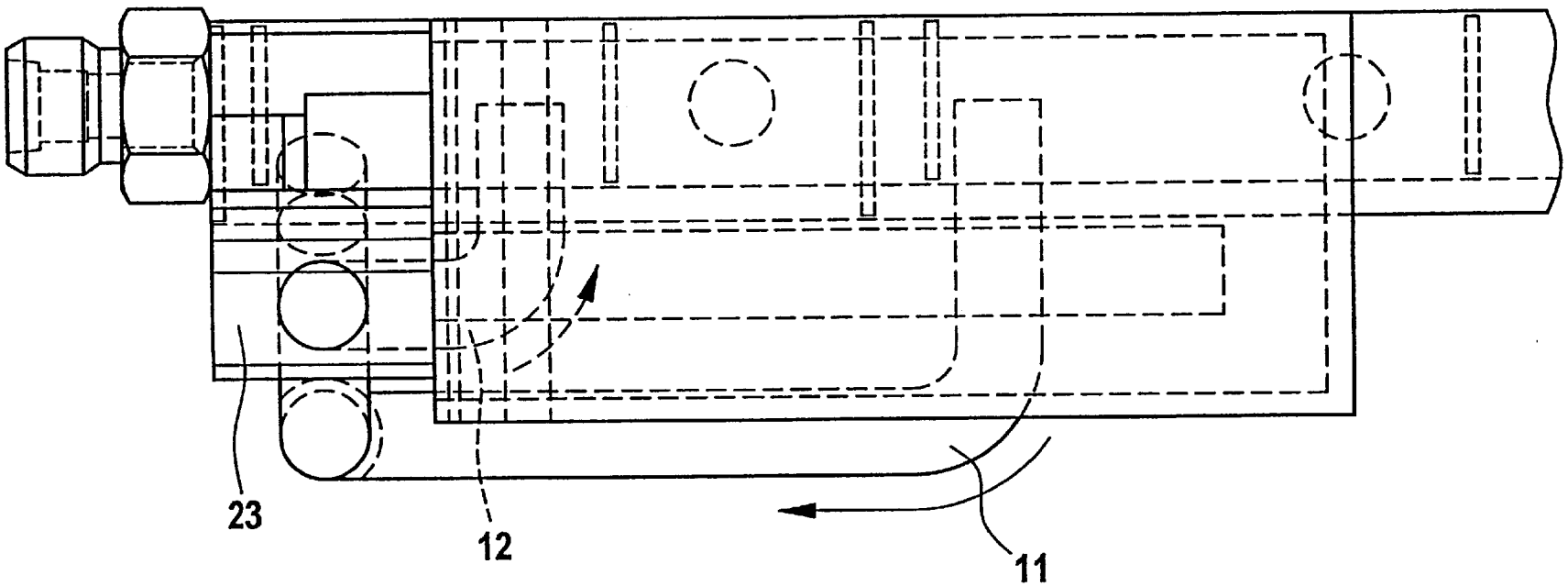
FIG. 4 is a partial end view showing an enlarged view of the container housing a dryer and of the connecting lines.

FIG. 2, FIG. 3 and FIG. 4 show a preferred connection of the additional collector container 10 to the collector 7, in an enlarged illustration. As already stated above, the tubular collector 7 is connected via the two passage orifices 8 and 9 to the header tube 3 or its chambers between the partitions 15/16 and 16/17. For the connection of the (drying) container 10, there are provided in the collector two junction orifices 19 and 20, between which is located a partition 18 which subdivides the collector 7 into an upper chamber 21 and a lower chamber 22. A connecting tube 11 (FIG. 4) leads from the first junction orifice 19 into the lower region, i.e., a connection piece 23 of the drying container 10, and, from there, via a vertically arranged tube 24 into the interior 25 of the (drying) container 10.

The connection piece or flange 23 may be brazed or welded to the collector 7 and thus serves as a holder for the container 10. The second connecting tube 12 leads from the second junction orifice 20 in the collector 7 likewise into the connection piece 23 and, from there, into the interior 25 of the container 10. The container 10 or its interior 25 is thus connected in parallel to the chambers 21 and 22 or between the condensation section C and the supercooling section D. Inside the drying container 10 is preferably located, in a way not illustrated in detail, a dryer, for example, in the form of a granulate, and/or a filter for removing particles from the refrigerant.

The condenser described above functions as follows: the refrigerant in vapor form enters the condenser through the inlet connection piece 5 and, by virtue of the partition 13, in a first passage A is deflected according to the arrows a to the header tube 3, then flows in a second passage B, according to the arrows b, again to the right and from there in a third passage C, according to the arrows c, again to the left. There, the refrigerant enters the collector 7, i.e., the upper chamber 21, through the passage orifice 8. Phase separation into liquid and vapor takes place in this chamber; the liquid phase of the refrigerant then flows via the connecting tube 11 into the drying container, where drying and filtering, and preferably also further phase separation, take place. The liquid phase is then drawn off via the connecting tube 12, flows into the lower chamber 22 of the collector, and, from there, flows via the passage orifice 9 into the chamber of the header tube 3 between the partitions 16 and 17, and then flows in a fourth passage D, according to the arrows d, through the tube/fin block. After a final passage E, according to the arrows e, the refrigerant leaves the condenser in the liquid phase and in the supercooled state, via the outlet connection piece 6.

In contrast to the above description, the additional container 10 and the collector 7 may be produced as a separate structural unit which is combined with the condenser (which has only the header tubes). The production costs of the entire condenser can be reduced by means of this measure.

The condenser is incorporated in a way known per se into the refrigerant circuit of a motor vehicle air-conditioning system. In spatial terms, it is arranged in the vehicle preferably in front of the coolant/air cooler (radiator) for the engine. The invention is particularly suitable for use in those situations where two or more heat exchangers are to be mounted in closely fitted relationship, e.g., face-to-face, in order to conserve space and to provide for ease in servicing. For example, in addition to the radiator/condenser combination mentioned above, additional heat exchangers can be mounted in close adjacent relationship, such as an oil cooler and/or a charge air cooler. The present invention enables such combinations to be accomplished in less space than with prior condensers that include an integral collector.

The present invention has been described with reference to only a few preferred embodiments. Various modifications of the disclosed embodiments will be apparent to persons skilled in this field, and it is intended that the appended claims cover the invention in its broadest sense, including obvious equivalents.

What is claimed is:

1. A refrigerant condenser for a motor vehicle air-conditioning system, comprising:

a tube/fin block;

header tubes arranged on both sides of the tube/fin block, the header tubes having partitions for creating multi-pass flow of the refrigerant to produce in the tube/fin block an upper condensation region and a lower supercooling region;

a collector arranged parallel and adjacent to one of the header tubes and being in communication via a first passage with the condensation region, and via a second passage with the supercooling region, wherein the collector has a diameter or cross section essentially the same or less than the cross section of the adjacent header tube; and a separate container having a cross section larger than the cross section of the adjacent header tube, for storing refrigerant and receiving at least one of a dryer and a filter, the container being in communication with the collector via connecting lines, wherein a first connecting line is connected to the collector between the first passage to the condensation region and the second passage to the supercooling region.

2. A refrigerant condenser as claimed in claim 1, wherein the collector includes a partition therein, above which a first junction orifice for the first connecting line is located and below which a second junction orifice for a second connecting line is located.

3. A refrigerant condenser as claimed in claim 1, wherein the separate container has a cylindrical cross section having a diameter approximately at least double that of the of the collector.

4. A refrigerant condenser as claimed in claim 3, wherein the separate container has a cylindrical cross section having a diameter approximately 2 to 3 times that of the of the collector.

5. A refrigerant condenser as claimed in claim 3, wherein the separate container has a height that is approximately one third to half the height of the collector.

6. A refrigerant condenser as claimed in claim 1, wherein the connecting lines comprise tubes which serve additionally as holders for the separate container.

7. A refrigerant condenser as claimed in claim 1, further comprising a flange for connecting the container to the condenser.

8. A refrigerant condenser as claimed in claim 1, wherein the separate container and the collector are produced as a separate structural unit before the collector is joined with the header tube.

9. A motor vehicle comprising an air-conditioning system including a refrigerant condenser as defined by claim 1.

10. A motor vehicle comprising an engine cooling system including a radiator, and an air-conditioning system including a refrigerant condenser, wherein the condenser comprises a condenser as defined in claim 1 and wherein the condenser and the radiator are mounted in the motor vehicle contiguously in face-to-face relationship.

11. A motor vehicle as claimed in claim 10, further comprising a third heat exchanger that is mounted directly adjacent to one of said radiator and said condenser.

12. A motor vehicle as claimed in claim 11, wherein the third heat exchanger comprises at least one of an oil cooler and a charge air cooler.

* * * * *